United States Patent [19]

Street

[11] 4,428,992

[45] Jan. 31, 1984

[54] METHOD OF SPLICING REINFORCEMENT FIBER

[75] Inventor: Sidney W. Street, Hacienda Heights, Calif.

[73] Assignee: Hitco, Irvine, Calif.

[21] Appl. No.: 320,512

[22] Filed: Nov. 21, 1981

[51] Int. Cl.[3] ..... B65H 19/18; B65H 69/02; B65H 69/06

[52] U.S. Cl. ..... 428/114; 57/22; 156/158; 242/58.1; 428/294; 428/473.5

[58] Field of Search ..... 156/158; 57/22; 242/58.1; 428/114, 294, 473.5

[56] References Cited

U.S. PATENT DOCUMENTS

| | | | |
|---|---|---|---|
| 469,015 | 2/1892 | Hemenway | 156/158 |
| 3,070,947 | 1/1963 | Toledo et al. | 156/158 |
| 3,386,871 | 6/1968 | Dulin et al. | 156/158 |
| 3,607,507 | 9/1971 | Enos | 156/158 |
| 3,665,586 | 5/1972 | Lacey | 156/158 |
| 3,904,458 | 9/1975 | Wray | 156/158 |
| 4,028,162 | 6/1977 | Cherin et al. | 156/158 |
| 4,077,822 | 3/1978 | Logwin | 156/158 |

*Primary Examiner*—James C. Cannon
*Attorney, Agent, or Firm*—Marvin E. Jacobs

[57] ABSTRACT

Reinforcement fiber for fiber-reinforced resin composites such as graphite tows are spliced by applying a solution of a linear, soluble, high glass transition temperature polyimide having good thermal-oxidative stability to the broken ends of a fiber, placing the ends in contact and removing solvent. The preferred polyimide is an aromatic-cycloaliphatic diamine such as 5,(6)-amino-1-(4' amino phenyl)-1,3-trimethylindane (DAPI) imidized with a dianhydride such as PMDA or BTDA. The soluble polyimide can be preapplied to the fiber as a sizing. The splices are not apparent by visual inspection nor by instrumental scanning of cured composites indicating there is no blistering nor loss of strength.

23 Claims, 6 Drawing Figures

METHOD OF SPLICING REINFORCEMENT FIBER

DESCRIPTION

Technical Field

The present invention relates to fiber reinforced resin composites and more particularly to a method of coating and splicing reinforcement fiber.

Background Art

Considerable interest exists in future use of fiber reinforced plastics (FRP) due to their lightweight and high strength. Presently, about 30 pounds of fiber reinforced plastic are being utilized per plane in the manufacture of several existing aircraft. Future projected use is over 1,000 pounds per aircraft. Due to the need to reduce weight of automobiles to increase fuel efficiency, use of fiber reinforced plastics in cars is also expected to increase dramatically over the next decade. Reinforcement fibers such as fiberglass, graphite, carbon, boron, Kevlar (aromatic polyimide), Kuralon (high molecular weight polyvinyl alcohol), or the like are manufactured in roving, yarn or multifilament fiber form. The fibers can also be woven into a cloth.

All of these fibers can be impregnated with binder or matrix resin to form products called pre-pregs. It is not uncommon for filaments or fibers to break during impregnation. Also it is necessary to splice ends to provide continuous lengths of fiber.

Carbon-graphite fibers are being utilized in an increasing number of products due to the flexibility, strength and lightweight of the fiber reinforced composites utilizing these fibers.

Commercial carbon-graphite fibers are usually sold as a stranded material or as a woven cloth, having from 100 to 10,000, generally 1,000 to 10,000, discrete thin fibers per strand. These fibers are prepared by heating a precursor such as rayon, pitch or polyacrylonitrile fiber to carbonize the fibers followed by a high temperature (2,000°-3,000° C.) graphitization treatment under stress in absence of oxygen during which it is believed that the carbon atoms rearrange into a hexagonal structure. The industry has developed fine strand multifilament products as the result of difficulties in manufacturing large diameter fiber of sufficiently high modulus. It will be noted that an extremely small fiber diameter is now the industry standard, and is not predicted to change very much in the immediate future. Typical properties are presented in the following Table I.

TABLE I

| | |
|---|---|
| Carbon Fiber Diameter | 5.0 to 100 microns |
| Modulus | 10 to 100 million psi |

It is not uncommon for the very fine filaments or fibers to break during impregnation requiring application of a patching or splicing compound. It is also necessary to splice fiber ends to provide continuous lengths of fibers.

Currently, solvent solutions of cellulose esters are used to splice and patch reinforcement fiber. This material dries quickly to yield a bond in the roving or other fiber form allowing the process to continue without interruption. However, during the subsequent manufacture of a composite, the cellulose acetate exhibits low heat resistance and causes blisters. Furthermore, cellulose acetate exhibits a different color than the matrix resin. Therefore, the patch or splice is not aesthetically pleasing to the aircraft manufacturing customer and inspector and it appears that the material is non-uniform and of low quality. Ultrasonic scans of composites containing such splices show void areas at the locations of the patches and splices. This indicates incompatibility with the binder resin and also could be an indication of local potential failure or premature failure.

DISCLOSURE OF THE INVENTION

An improved method for coating and repairing reinforcement fibers is provided in accordance with the present invention. The coating composition of the invention is conveniently applied to the fiber ends at room temperature rapidly dries to form a heat-resistant, strong, flexible splice that is compatible with the matrix resin and is insoluble in the solvent for the matrix resin. The patch of tow splicing exhibits high heat resistance, is aesthetically pleasing and is not apparent on visual or instrumental scanning or testing of a resultant composite or an article or product manufactured from a cured composite. Since the splicing compounds are quite stable at high temperatures, and are compatible with the binder resin, no blistering or loss of strength is experienced with composites containing splices prepared in accordance with the invention. The coating composition of the invention can be pre-applied to the surface of the fibers as a sizing so that it is available at all times for repair of any breaks by solvent welding. During solvent welding the broken ends are simply dipped into or wetted with solvent so that the sizing coating on the surface temporarily dissolved when the ends are overlapped. When the solvent evaporates, a splice is formed.

The splicing composition utilized in the invention contains a soluble, linear, polyimide having a glass transition temperature of at least 200° C. and no more than 500° C., preferably from 250° C. to 400° C., dissolved in a low boiling, fast evaporating solvent having a boiling temperature below about 150° F., preferably below about 100° F., so that the solvent evaporates quickly at room temperature. A suitable solvent is methylene chloride. The polyimide resin content of the splicing solution is generally from about 2 to 20%, preferably about 3 to 10%.

A break in a continuous filament or ends of separate filaments can readily be joined by dipping the ends of the filament or fiber into the splicing solution, overlapping the ends and twisting them and holding them in contact for about 10 seconds until the solvent is evaporated. A strong, aesthetically pleasing bond is formed in a few minutes. A sizing on a basis of 0.1% to 4% by weight of resins on fiber can be applied from a conventional coating bath. The splicing compound of the invention is found to be extremely compatible with epoxy, polyimide or polyester matrix-binder resins. Ultrasonic scans of FRP composites containing splices prepared in accordance with the invention do not show any voids. Cured composites containing splices in accordance with the invention are more uniform in appearance. Since the glass transition temperature of the splicing resin is so high, typically 250° to 400° C., the resin will soften but not lose strength during cure of the composite. The spliced filament can be incorporated into prepreg, filament wound or pultruded composites.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1A:
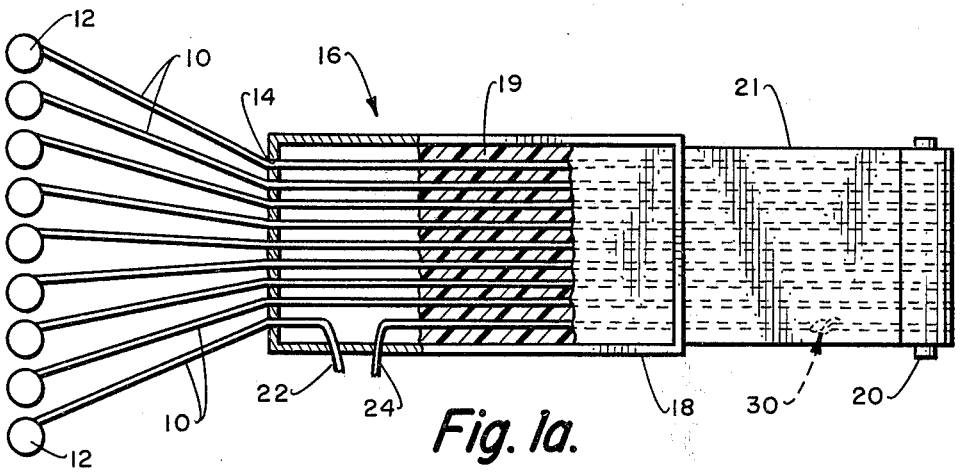
FIGS. 1*a* to 1*d* is a schematic view of a system for splicing a tow in accordance with the invention.
Figure 1B:
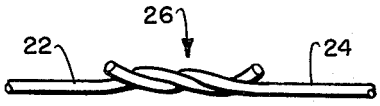
Figure 1D:
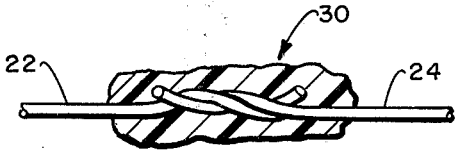
Figure 1C:
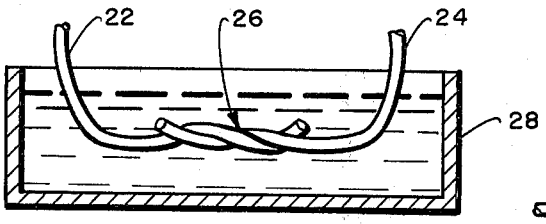

Referring now to FIG. 1, a prepreg is formed by feeding a plurality of tows 10 from unwind reels 12 through the openings 14 in a collator 16. A layer of parallel tows is positioned in a casting tray 18. A quantity of liquid matrix 19 resin such as epoxy, polyester or polyimide is fed into the tray and solidified by cooling or by advancing cure to form a sheet of prepreg. The sheet of prepreg 21 is wound up on rewind reel 20. In case of a break of any one of the tows 10, the broken ends 22, 24 are overlapped and turned to form a twist 26. The twisted portion 26 is immersed in a tank 28 containing a solution of soluble polyimide resin to form a spliced coated area 30. After the coated area is held one to ten seconds until dry, it is released and the fiber tow is returned to the casting tray for completion of the manufacture of the prepreg.

Figure 3:
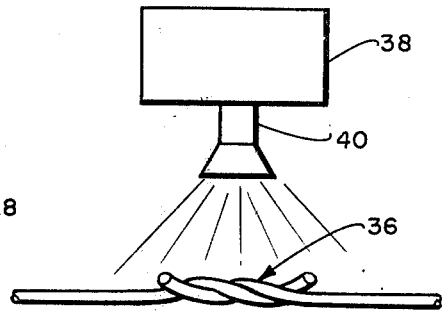
FIG. 3 is an enlarged view of splicing the coated fiber of FIG. 2.
Figure 2:
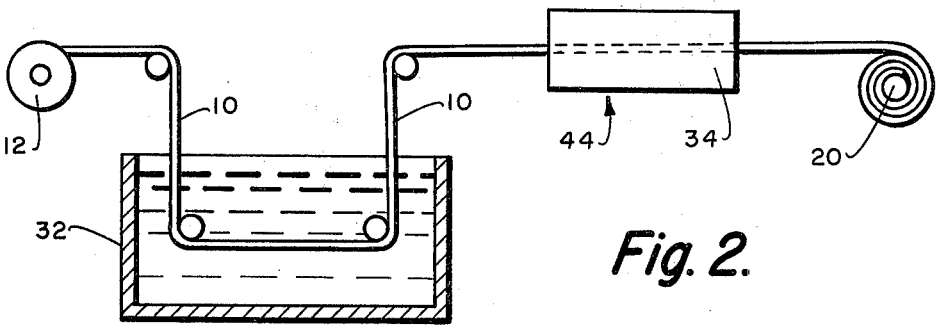
FIG. 2 is a schematic view of a system for applying a sizing to a reinforcement fiber before forming a sheet of prepreg.

Referring now to FIG. 2, each tow 10 from unwind reel 12 is preliminarily coated with a thin coating of a soluble polyimide in coating tank 32 before delivery to the collating station 44 of the prepreg coater 34. As shown in FIG. 3, in case of a break, the ends of the polyimide sized fibers are simply overlapped and twisted and a polyimide solvent is sprayed onto the twisted portion 36 from spray bottle 38 containing a nozzle 40. The solvent dissolves the sizing coating on both ends to form a solvent weld. After holding for one to ten seconds the spliced tow is ready for further processing such as forming prepreg.

Prepregs generally contain from 30 to 70% by volume of fiber, typically from 50 to 65% of fiber. Composites are formed by laying up sheets of prepreg in unidirectional or bidirectional lay up of sheets then heating the assembly under pressure at temperatures from 250° to 650° F. to form solid fiber reinforced resin composites. The splices are formed from aromatic polyimides having high glass transition temperatures of 250° to 450° C. These resins soften but do not lose strength during curing of the composites and thus maintain a reliable splice. The prepreg or matrix pregnating resin can be applied from bulk or from a solution. The polyimide sizing or splicing compound is resistant to typical matrix resin solvents such as ketones, for example, methyl-ethyl ketone and alcohols.

There are several synthetic routes to formation of soluble polyimides. The polyamic acid approach has drawbacks in that water of imidization is released which can create weakening voids in the sizing or in the splice. Other methods of solubilizing polyimides such as incorporation of polyether linkages or pendant groups tend to lower the glass transition temperature of the polyimide.

The preferred polyimides for use in accordance with the invention incorporate an aromatic-cycloaliphatic diamine such as compounds of the formula:

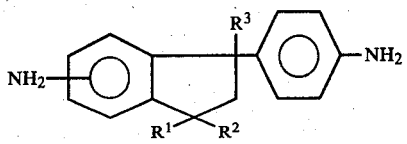

where $R^1$, $R^2$ and $R^3$ are individually selected from the group consisting of hydrogen, lower alkyl of 1 to 5 carbon atoms or alkoxy of 1 to 5 carbon atoms. An easily prepared commercially available material is 5,(6)-amino-1-(4'amino phenyl)-1,3-trimethylindane. This diamine when imidized with commercially available dianhydrides such as benzophenonetetracarboxylic dianhydride (BTDA) or pyromellitic dianhydride (PMDA) results in a polyimide soluble in relatively non-polar solvents such as methylene chloride and is characterized by exceptionally high glass transition temperatures (Tg) and high thermal-oxidative stability. Terpolymers can be prepared by replacing part of the aromatic-cycloaliphatic diamine with from 1 to 25% by weight of other aromatic diamines. Though the chemical resistance increases, the solubility decreases with increasing substitution of aromatic diamine. A suggested comonomer is methylene dianiline.

Polyimides are prepared by adding a dianhydride to a 15–20% solution of the diamine in a solvent such as N-methyl pyrrolidone (NMP), adjusting the polyamic acid concentration to 15 to 20% and stirring the reaction mixture at room temperature for 18 hours. Acetic acid anhydride-pyridine was used to chemically imidize the polyamic acid. The resulting polyimide is isolated by precipitation in water. BTDA polyimides are characterized by a Tg of 320° C. and solubility in cyclic ethers, chloroform, cyclohexanone, m-cresol and amide solvent such as NMP and DMF. BTDA copolymers incorporating as much as 25% of methylene dianiline had little effect on the Tg or the solubility. At 50% methylene dianiline content the Tg is 300° C. Above 50% MDA insoluble gels formed after imidization.

The PMDA polyimides were the most soluble and had higher Tg's of well over 400° C. The polyimide of PMDA is soluble in glyme, diglyme, 2-methoxy-ethyl acetate (2-MEA), isophorone, cyclohexanone, m-cresol and NMP, DMF and methylene chloride. Reduced solubilities are observed at 25% MDA level. Insoluble gels are formed at 40% MDA content. The BDTA polyimides are more chemically resistant than the PMDA polyimides.

A dilute solution of the copolymer of DAPI and MDA was dissolved in methylene chloride to form a 6–7% solution. A 6,000 filament carbon graphite fiber tow was cut, the ends were dipped in this solution overlapped and twisted. A splice was formed that was resistant to soaking in MEK over 3 days.

A thousand filament carbon-graphite fiber tow was spliced according to the following procedure. The tow ends to be spliced were dipped in solvent such as methylene chloride. This simple wetting appears to consolidate the fibers in the tow ends. The tow ends were then dipped to a depth of about 0.5 inch DAPI-PMDA solution having a solids content of 8.7%. The solution-coated tow ends were then overlapped and gently rolled together by the operator wearing surgical rubber gloves. As methylene chloride has a very low boiling point (104° F.), a splice of good integrity resulted almost immediately.

Tows containing splices were formed into epoxy prepregs, layed up and cured to form composites. The splices have a clear appealing color and do not show a color contrast visually when formed into prepreg or into composites. After cure, ultrasonic scans of composites containing such splices do not show any void areas indicating that a strong, high temperature bond is formed by the splicing procedure of this invention.

It is to be realized that only preferred embodiments of the invention have been described and that numerous substitutions, modifications and alterations are permissible without departing from the spirit and scope of the invention as defined in the following Claims.

I claim:

1. A method of splicing a reinforcement fiber for reinforcing a composite with a matrix resin comprising the steps of applying to the ends of two of said fibers a solution of linear polyimide having a glass transition temperature of at least 200° C. dissolved in a fast evaporating solvent having a boiling point below 150° F.; said polyimide being insoluble in the solvent utilized to dissolve said matrix resin, having high heat resistance and being compatible with said matrix resin;

placing the coated ends in contact;

drying the solution to remove said fast evaporating solvent in less than one minute to form a continuous splice of said polyimide joining said ends.

2. A method according to claim 1 in which the solution is applied to the fiber and dried to form a sizing and said splice is formed by dissolving the sizing adjacent broken ends of the fiber by applying said fast evaporating solvent thereto.

3. A method according to claim 1 in which the fast evaporating solvent is applied to the broken ends of the fiber before application of the solution of polyimide.

4. A method according to claim 1 in which the fiber is selected from carbon, graphite, fiberglass, boron, aromatic polyimide or polyvinyl alcohol.

5. A method according to claim 4 in which the fiber is graphite or carbon.

6. A method according to claim 4 in which the soluble polyimide is a linear polyimide having a glass transition temperature of at least 250° C. to 450° C.

7. A method according to claim 6 in which the solvent has a boiling point below 100° F. and evaporates in less than 10 seconds.

8. A method according to claim 7 in which the solvent is methylene chloride.

9. A method according to claim 1 further including the step of impregnation the splice-containing fiber with a matrix, reinforcement resin to form prepreg, filament wound or pultruded composites.

10. A method according to claim 9 in which the splice containing fiber is coated with reinforcement resin to form a sheet of prepreg.

11. A method according to claim 10 further including the steps of assembling a plurality of sheets of prepreg into an assembly and curing the matrix resin to form a fiber reinforced composite containing at least one of said splices.

12. A method according to claim 9 in which the matrix resin is selected from epoxy, polyimide or polyester resins and the matrix resin solvent is selected from ketones and alcohols.

13. A method according to claim 1 in which the polyimide is the polymerizate of an aromatic-cycloaliphatic diamine imidized with a dianhydride.

14. A method according to claim 13 in which the diamine is selected from compounds of the formula:

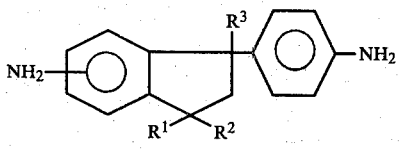

where $R^1$, $R^2$ and $R^3$ are individually selected from the group consisting of hydrogen, lower alkyl of 1 to 5 carbon atoms or alkoxy of 1 to 5 carbon atoms.

15. A method according to claim 14 in which the dianhydride is selected from benzophenonetetracarboxylic dianhydride or pyromellitic dianhydride.

16. A method according to claim 15 in which the diamine is 5,(6)-amino-1-(4'-aminophenyl)-1,3-trimethylindane.

17. A method according to claim 12 in which the splice is the same color as the matrix resin and is absent voids.

18. A fiber-reinforced resin matrix article comprising filamentary reinforcement fiber containing a splice formed by coating overlapped ends of the fiber with a linear, aromatic polyimide having a glass transition temperature of at least 200° C., said polyimide being dried from solution in a fast evaporating solvent having a boiling point less than 100° F., being insoluble in solvents for the matrix resin, having a high heat resistance and being compatible with said matrix resin.

19. An article according to claim 18 in which the splice-containing fiber is embedded in a sheet of prepreg.

20. An article according to claim 19 in which said sheet of prepreg is contained in a cured fiber-reinforced resin composite.

21. An article according to claim 18 in which the polyimide is formed from imidization of an aromatic-cycloaliphatic diamine.

22. An article according to claim 18 in which the polyimide is a reaction product of a dianhydride selected from benzophenonetetracarboxylic dianhydride and pyromellitic dianhydride and the diamine is selected from compounds of the formula:

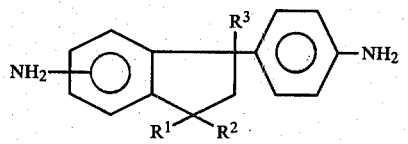

where $R^1$, $R^2$ and $R^3$ are individually selected from the group consisting of hydrogen, lower alkyl of 1 to 5 carbon atoms or alkoxy of 1 to 5 carbon atoms.

23. An article according to claim 20 in which the resin is selected from epoxy, polyimide and polyester resins.

* * * * *